United States Patent [19]

Barker et al.

[11] 4,276,237

[45] Jun. 30, 1981

[54] CARBURETOR AIR CONTROL DEVICE

[75] Inventors: Glenn B. Barker, Lincoln; William K. Coburn, III, Sudbury, both of Mass.

[73] Assignee: Standard-Thomson Corporation, Waltham, Mass.

[21] Appl. No.: 62,807

[22] Filed: Aug. 1, 1979

[51] Int. Cl.[3] ..... F02M 7/24

[52] U.S. Cl. ..... 261/39 A; 261/121 B; 137/81.1; 137/871; 137/628; 137/883; 137/884

[58] Field of Search ..... 261/121 B, 39 A; 137/81, 81.1, 871, 628, 883, 884

[56] References Cited

U.S. PATENT DOCUMENTS

| | | | |
|---|---|---|---|
| 2,177,544 | 10/1939 | Warner | 137/628 |
| 2,304,993 | 12/1942 | Franck | 137/628 |
| 2,486,223 | 10/1949 | Stresen-Reuter | 261/39 A |
| 2,734,776 | 2/1956 | Elliott | 137/628 |
| 2,751,919 | 6/1956 | Keil | 137/81 |
| 3,476,150 | 11/1969 | Loewenthal | 137/884 |
| 3,543,797 | 12/1970 | McNutt | 137/628 |
| 3,753,449 | 8/1973 | Nelson et al. | 137/601 |
| 3,881,513 | 5/1975 | Chang | 137/884 |
| 3,899,551 | 8/1975 | Korte | 261/121 B |
| 3,987,131 | 10/1976 | Hisatomi et al. | 261/121 B |
| 4,007,721 | 2/1977 | Regueiro | 261/121 B |
| 4,097,563 | 6/1978 | Yuzawa | 261/121 B |
| 4,100,234 | 7/1978 | Lindberg et al. | 261/121 B |
| 4,129,622 | 12/1978 | Tamazawa et al. | 261/42 |
| 4,177,224 | 12/1979 | Yamanaka et al. | 261/121 B |
| 4,181,108 | 1/1980 | Bellicardi | 261/42 |

*Primary Examiner*—Tim R. Miles

*Attorney, Agent, or Firm*—Jacox & Meckstroth

[57] ABSTRACT

A carburetor air control valve device which accurately meters air flow to each of the ports of a carburetor. A plurality of closure members of the poppet type are operated by expansion of a bellows member, as the bellows member expands in response to changes in density of the air to which the valve device is subjected. Each of the closure members is adapted to control flow of air to a port of an automotive carburetor.

7 Claims, 6 Drawing Figures

CARBURETOR AIR CONTROL DEVICE

BRIEF SUMMARY OF THE INVENTION

It is important that a proper fuel-air ratio exists at all times in a carburetor of an internal combustion engine. However, as an automotive vehicle travels, it is subjected to various altitudes, and the density of the air changes with changes in altitude. To compensate for differences in air density, when higher altitudes are experienced, a greater volume of air should reach the carburetor, and when lower altitudes are experienced, a lesser volume of air should reach the carburetor for a given throttle position.

A carburetor air control device of this invention comprises a housing through which air may flow to the several ports of an automotive carburetor. Within the housing a wall is provided with a plurality of orifices therethrough. A closure member normally closes each of the orifices. A bellows member, through expansion thereof, moves the closure members in a predetermined sequence to open the orifices for flow of a greater volume of air to ports of the carburetor as the air control device is subjected to air of lesser densities. Thus, the volume of air is increased to accurately compensate for decreases in air density. Thus, an effective fuel-air ratio to an automotive carburetor is maintained substantially constant even though the density of air flowing to the carburetor changes.

It is therefore an object of this invention to provide an automotive carburetor air control device which automatically and properly controls the quantity of air flow to an automotive carburetor at any altitude to which the automotive carburetor is subjected.

Another object of this invention is to provide such a carburetor air control device which controls the fuel-air ratio at all of the primary, secondary, and idle ports of a carburetor.

It is another object of this invention to provide such a carburetor air control device which precisely meters air which flows to all ports of a carburetor.

Other objects and advantages of this invention reside in the construction of parts, the combination thereof, the method of production, and the mode of operation, as will become more apparent from the following description.

DETAILED DESCRIPTION OF THE INVENTION

Figure 1:
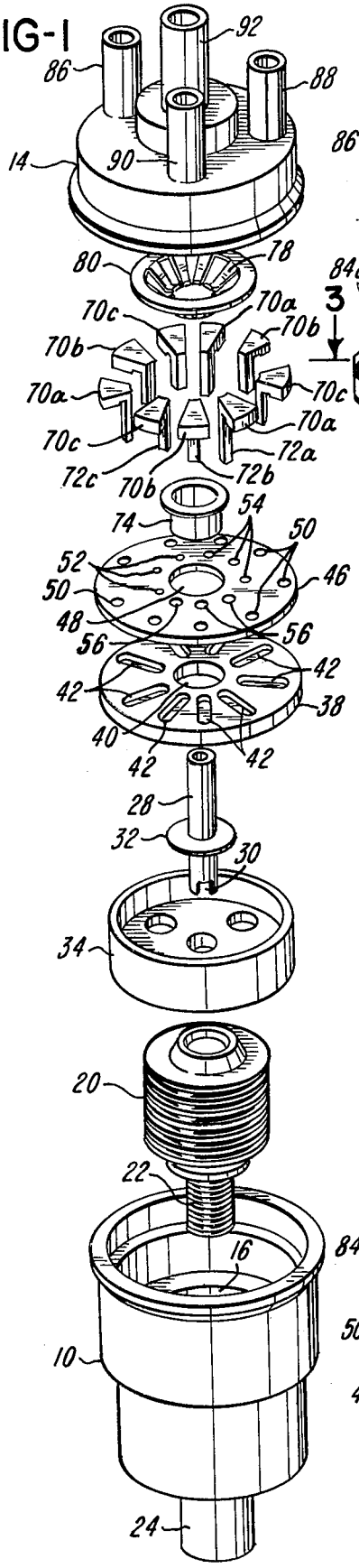
FIG. 1 is an exploded perspective view of a carburetor air control device of this invention.

A carburetor air control device of this invention comprises a housing 10 which is provided with a cap 14, which closes one end of the housing 10. The housing 10 has a chamber 16 therein. Within the lower part of the chamber 16 is a bellows member 20, which is preferably evacuated. The bellows member 20 has a threaded end portion 22 which is threadedly adjustably positioned within a protuberance 24 of the housing 10 and is thus adjustably positioned within the chamber 16 of the housing 10.

In engagement with the upper end portion of the bellows 20 is a hollow actuator rod 28, which has a transverse opening 30 at the lower end thereof. A disc 32 encompasses the actuator rod 28 and is secured thereto. Between the lower end of the actuator rod 28 and the disc 32 is a guide plate 34 which slidably encompasses the actuator rod 28 and which is supported by the housing 10 within the chamber 16.

In spaced relationship above the guide plate 34 is a channel plate 38 which also encompasses the actuator rod 28. The channel plate 38 is also supported by the housing 10 within the chamber 16 and has a central opening 40 which extends through the channel plate 38. The channel plate 38 has a plurality of radially extending channels 42 therein which have a depth less than the thickness of the channel plate 38.

Also encompassing the actuator rod 28 immediately above the channel plate 38 is an orifice plate 46, which has a central opening 48. If desired, the orifice plate 46 may be provided with a resilient sealing surface at the upper portion thereof. As best illustrated in FIG. 1, the orifice plate 46 is provided with a plurality of spaced-apart outer orifices 50 adjacent the periphery thereof. Spaced radially inwardly from the outer orifices 50 are groups of orifices 52, 54, and 56, all of which are substantially equidistant from the central opening 48. The orifices 54 are somewhat larger than the orifices 52, and the orifices 56 are somewhat larger than the orifices 54. Each of the orifices 52, 54, and 56 has a precisely determined area. Each of the orifices 52, 54, and 56 is in radial alignment with one of the outer orifices 50. Thus, each of the orifices 52, 54, and 56 and one of the orifices 50 form a pair of orifices, there being one pair of the orifices above each of the channels 42 of the channel plate 38.

Immediately above the orifice plate 46 and normally in engagement therewith are annularly arranged closure members 70 having stems 72 which encompass the actuator rod 28. Each of the closure members 70 covers one of the inner orifices 52, 54, or 56 of the orifice plate 46. The closure members 70 are shown as being closure members 70*a*, 70*b*, and 70*c*. Herein, there are three closure members 70*a*, three closure members 70*b*, and three closure members 70*c*. One closure member 70*a*, one closure member 70*b*, and one closure member 70*c* close the orifices 52. One closure member 70*a*, one closure member 70*b*, and one closure member 70*c* close the orifices 54. One closure member 70*a*, one closure member 70*b*, and one closure member 70*c* close the orifices 56.

Figure 2:
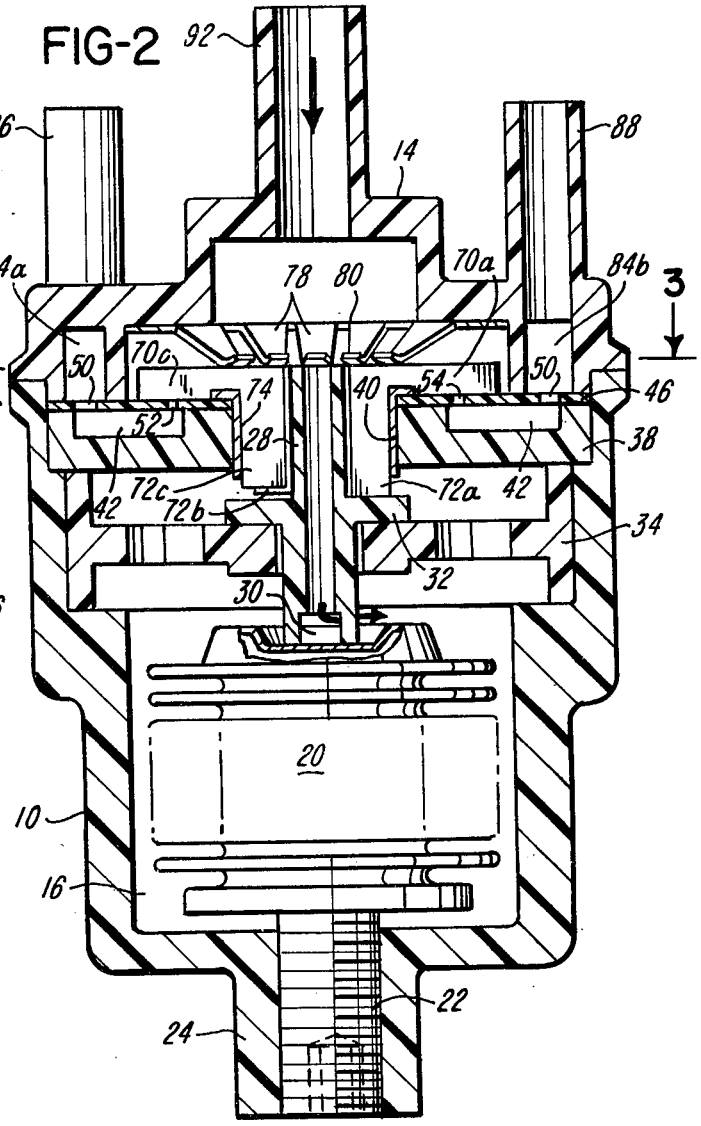
FIG. 2 is a longitudinal sectional view of the device of FIG. 1, drawn on a larger scale than FIG. 1.

The stem 72 of the closure members 70 are substantially normal to the closure members 70. The stems 72 are of various lengths. In the structure shown herein, each of the closure members 70*a* has a long stem 72*a*. Each closure member 70*b* has a stem 72*b* which is intermediate in length, and each closure member 70*c* has a stem 72*c* which is shortest in length. The stems 72 are slidably encompassed by a guide cylinder 74 which is positioned within the openings 48 and 40 of the orifice plate 46 and of the channel plate 38, respectively. The lower ends of the stems 72 are immediately above the disc 32 which is attached to the actuator rod 28. As shown in FIG. 2, due to the fact that the stems 72*a* are the longest stems, the lower ends of the stems 72*a* are normally closest to the disc 32.

Figure 4:
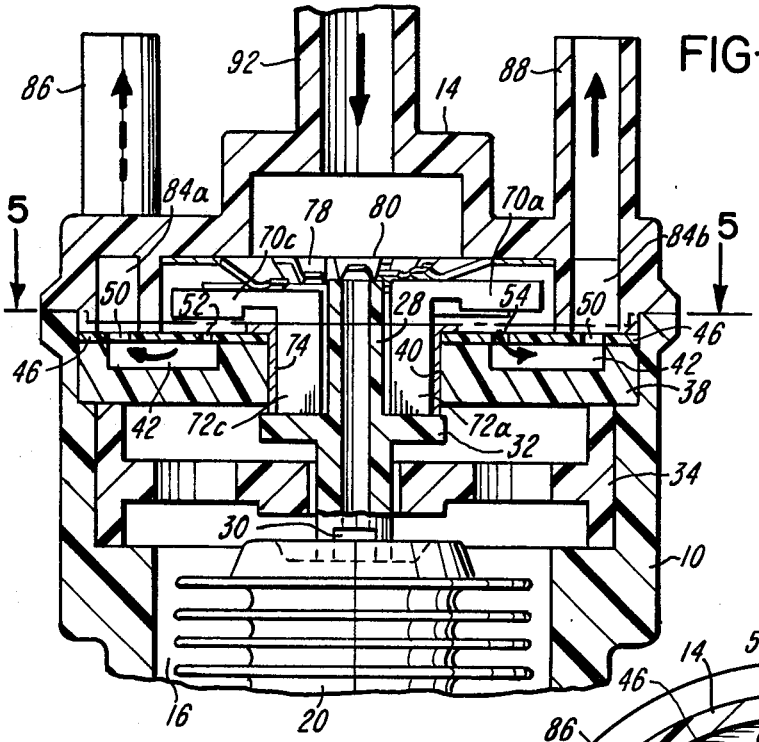
FIG. 4 is a fragmentary sectional view showing a portion of the air control device as illustrated in FIG. 2, but showing elements thereof in another position of operation.

Above the closure members 70 and in engagement therewith are a plurality of resilient fingers 78, there being one resilient finger 78 in engagement with each of the closure members 70. The resilient fingers 78 are attached to an annular connector member 80. The annular connector member 80 is positioned within a portion of the cap 14 and is retained thereby, as best shown in FIGS. 2 and 4.

Figure 3:
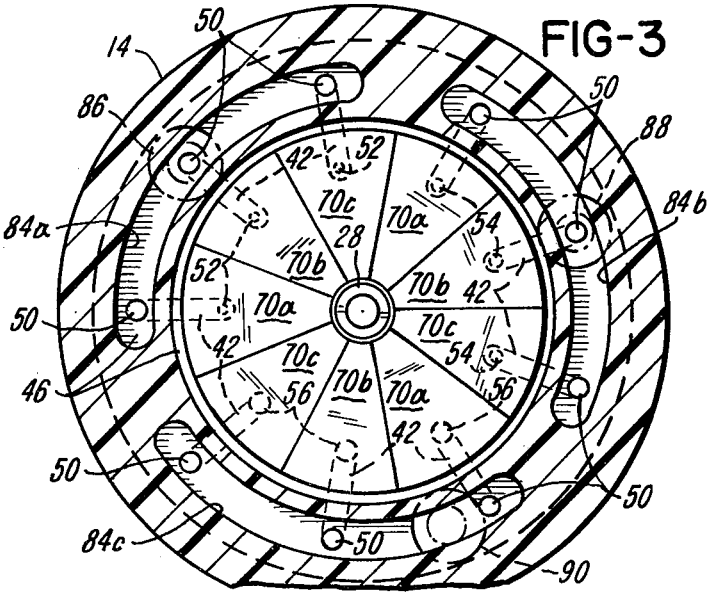
FIG. 3 is a sectional view taken substantially on line 3—3 of FIG. 2.
Figure 5:
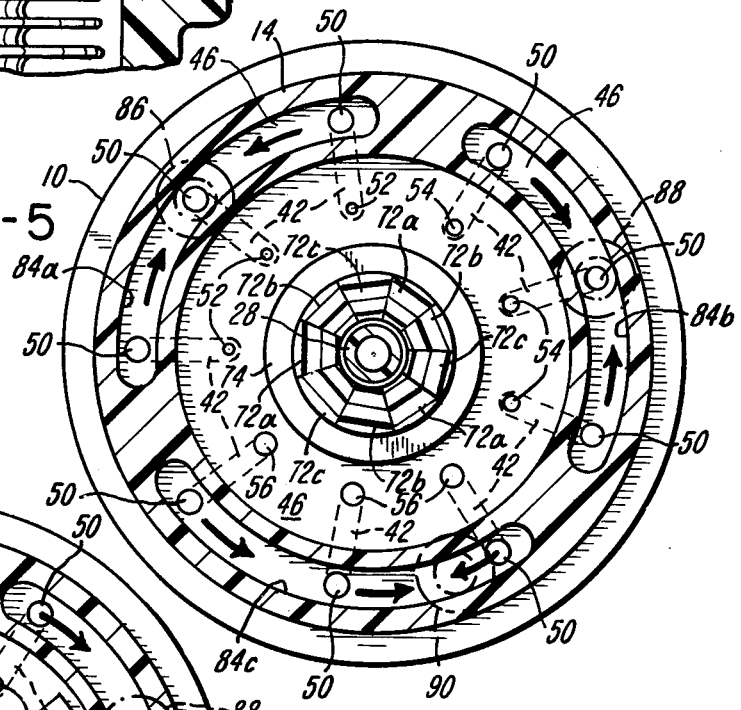
FIG. 5 is a sectional view taken substantially on line 5—5 of FIG. 4.
Figure 6:
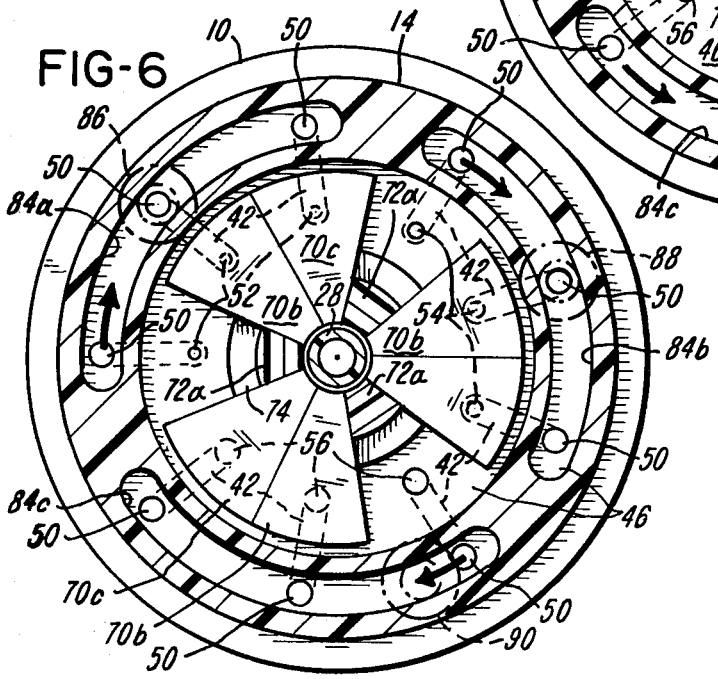
FIG. 6 is a sectional view, similar to FIG. 5, but showing elements in another position of operation.

The cap 14 is secured to the housing 10 in any suitable manner, not shown. The cap 14 is provided adjacent the periphery thereof with arcuate passageways 84*a*, 84*b*, and 84*c*, as best shown in FIGS. 3, 5, and 6. As illustrated, each of the arcuate passageways 84 encloses three of the orifices 50 of the orifice plate 46.

The cap 14 is provided with conduits 86, 88, and 90 which are shown as extending upwardly therefrom. Each of the arcuate passageways 84 is in communication with one of the conduits 86, 88, or 90. Herein the arcuate passageway 84*a* is in communication with the conduit 86. The arcuate passageway 84*b* is in communication with the conduit 88, and the arcuate passageway 84*c* is in communication with the conduit 90.

The central portion of the cap 14 has a conduit 92 extending upwardly therefrom. The conduit 92 is in communication with the internal central portion of the cap 14, as best illustrated in FIGS. 2 and 4.

Operation

The conduit 92 is adapted to receive air from the atmosphere, through any suitable fluid conductor, not shown. Each of the conduits 86, 88, and 90 is adapted to be in communication with a port of a carburetor of an internal combustion engine. For example, the conduit 86 is in communication with the idle port; the conduit 88 is in communication with the fuel jet of the secondary band, and the conduit 90 is in communication with the fuel jet of the primary band of a carburetor. Thus, during operation of the internal combustion engine of which a carburetor and a device of this invention are a part, air from the atmosphere flows into the housing 10 through the conduit 92. The air then fills the region surrounding the resilient fingers 78, above the closure members 70. Air also flows downwardly through the actuator rod 28. The air then flows into the chamber 16 surrounding the bellows member 20. However, the closure members 70 are normally in engagement with the orifice plate 46 and close the orifices 52, 54, and 56 thereof. Thus, under these conditions there is no flow of air through the orifices 52, 54, and 56 to the conduits 86, 88, and 90 for flow to the carburetor.

Due to the fact that the carburetor air control device of this invention is adapted to be a part of an automotive vehicle system, the carburetor air control device is subjected to changes in altitude during travel of the automotive vehicle. When the automotive vehicle travels to higher altitudes, the density of the air to which the carburetor air control device is subjected is less than at lower altitudes. When the density of the air is less than a predetermined value, the bellows member 20 increases in length. When this increase in length occurs, the actuator rod 28 is forced by the bellows member 20 to move slightly upwardly. Thus, the disc 32, carried by the actuator rod 28, is moved slightly upwardly. When the disc 32 is moved upwardly, the disc 32 first engages the stems 72*a* of the closure members 70*a*. The disc 32 thus lifts these stems 72*a* and their corresponding closure members 70*a* and moves these closure members 70*a* from engagement with the orifice plate 46, as illustrated in FIG. 6. Therefore, one orifice 52, one orifice 54, and one orifice 56 in the orifice plate 46 is opened for flow of air therethrough. Thus, air initially flows through one orifice 52, through one orifice 54, and through one orifice 56 in the orifice plate 46. Air flows through the orifice 52, through a channel 42 immediately therebelow, and then upwardly from the channel 42, through an orifice 50 which is in alignment therewith. The air then flows through a portion of the arcuate passageway 84*a* and outwardly through the conduit 86 and to the idle port of the carburetor. Simultaneously, air flows through one of the orifices 54, through its respective channel 42, through its respective orifice 50 through the arcuate passageway 84*b* and outwardly through the conduit 88. This air then flows to the secondary port of the carburetor. Simultaneously, air flows through one of the orifices 56, through its respective channel 42, through its respective orifice 50, through the arcuate passageway 84*c* and outwardly through the conduit 90, to the primary port of the carburetor.

Thus, when the bellows member 20 initially expands, the three long stems 72*a* are engaged by the disc 32 and moved upwardly. Thus, the three corresponding closure members 70*a* are moved from the orifice plate 46, as illustrated in FIG. 6, to permit flow of air through one orifice 52, through one orifice 54 and through one orifice 56. Due to the fact that the orifices 54 are larger than the orifices 52, a slightly greater volume of air flows through the orifice 54 than through the orifice 52. Therefore, a greater volume of air flows to the secondary port than to the idle port of the carburetor. Due to the fact that the orifices 56 are larger than the orifices 54, a greater volume of air flows through the orifice 56 than through the orifice 54. Therefore, a greater volume of air flows to the primary port of the carburetor than to the secondary port thereof. The sizes of the orifices 52, 54, and 56 are precisely determined. Therefore, the volume of air which flows to each of the ports of the carburetor is precisely metered to provide a given quantity of air to the carburetor to compensate for lower densities of the air to which the automotive vehicle is subjected.

As the automotive vehicle travels to a higher altitude, the bellows member 20 further expends in length and further moves the actuator rod 28 and the disc 32 carried thereby. When this occurs, the stems 72*b*, in addition to the stems 72*a*, are engaged by the disc 32 and are moved upwardly, and thus the closure members 70*b* are moved from engagement with the orifice plate 46 and uncover another orifice 52, another orifice 54, and another orifice 56. When this occurs, additional air is metered by these orifices 52, 54, and 56 and flows to the idle port, the secondary port, and the primary port, respectively, of the carburetor.

As the automotive vehicle travels to a still higher altitude, the bellows member 20 further expands in length and further moves the actuator rod 28 and the disc 32 thereof. When this occurs, the stems 72*c*, in addition to the stems 72*a* and 72*b*, are engaged by the disc 32 and are moved upwardly, and their respective closure members 70*c* uncover another orifice 52, another orifice 54, and another orifice 56. When this occurs, additional air is metered by these orifices 52, 54, and 56 and flows to the idle port, the secondary port, and the primary port, respectively, of the carburetor. When the bellows member 20 reaches such a length, all of the orifices 52, 54, and 56 are open, as illustrated in FIG. 4.

Movement of the closure members 70 in a direction from the orifice plate 46 is against the forces of the resilient fingers 78. As the automotive vehicle travels to a lower altitude, the bellows member 20 reduces slightly in length, and the resilient fingers 78 first force the closure members 70*c* to close their respective orifices 52, 54, and 56, as the closure members 70*c* return to engagement with the orifice plate 46. Thus, the flow of air to the carburetor ports is reduced. If the altitude position of the automotive vehicle is lowered sufficiently, the bellows member 20 reduces in length to such an extent that all of the closure members 70 are returned to closed position upon the orifice plate 46.

It is to be understood that a carburetor air control device of this invention may have any desired suitable number or sizes of orifices or groups of orifices in any desired arrangement, to provide accurate and incremental metering of air flow to various ports of a carburetor. Also, the closure members 70 may be so arranged and may have stems of such various lengths that orifices in the orifice plate 46 are opened and/or closed in any desired stepped sequence to provide various increments in the metered flow of air to ports of a carburetor.

Herein the terms "above", "below", etc, have been employed only for the purpose of describing the relative positions of parts or elements of the structure of this invention, and these terms are not intended to limit the structure of this invention and/or the operation thereof to any specific orientation. A carburetor air control device of this invention operates satisfactorily in a position or orientation as deemed desirable in any given situation.

Although the preferred embodiment of the carburetor air control device of this invention has been described, it will be understood that within the purview of this invention various changes may be made in the form, details, proportion and arrangement of parts, the combination thereof, and the mode of operation, which generally stated consist in a structure within the scope of the appended claims.

The invention having thus been described, the following is claimed:

1. Carburetor air control mechanism for control of air flow to a plurality of ports of a carburetor comprising:

a housing provided with a first portion and a second portion, an enclosed bellows member within the first portion of the housing, the bellows member having a pressure therewithin which is less than sea level atmospheric pressure, the bellows member being expansible in length when subjected to an atmosphere having density less than a given density, the second portion of the housing having an air inlet conduit and a plurality of air outlet conduits, each air outlet conduit being adapted to communicate with a port of a carburetor, an actuator rod axially movable by the bellows member upon expansion and contraction of the bellows member, an engagement element carried by the actuator rod for movement therewith, an orifice plate provided with a first group of orifices therethrough and a second group of orifices therethrough, a channel plate in juxtaposition with the orifice plate, the channel plate having a plurality of channels, each channel being in communication with an orifice of the first group of orifices and also in communication with an orifice of the second group of orifices, each of the orifices of the first group of orifices being in communication with one of the air outlet conduits, some of the orifices of the first group being in communication with one of the air outlet conduits and some of the orifices of the first group of orifices being in communication with another of the air outlet conduits, a plurality of closure members, each of the closure members normally covering and closing an orifice of the second group of orifices of the orifice plate, each closure member having a stem extending therefrom and engageable by the engagement element with movement of the actuator rod for movement of the closure member from the orifice plate to open the respective orifice, each orifice of the second group of orifices when open being in communication with the air inlet conduit, expansion of the bellows member causing axial movement of the actuator rod and movement of the engagement element, the engagement element engaging the stems of the closure members and moving the stems and moving the closure members from engagement with the orifice plate to open the second group of orifices for flow of air therethrough from the air inlet conduit, air flowing through each of the second group of orifices also flowing through a channel of the channel plate and through an orifice of the first group of orifices and to one of the air outlet conduits.

2. The carburetor air control mechanism of claim 1 in which the actuator rod has a passage therethrough for communication between the air inlet conduit in the second portion of the housing and the bellows member in the first portion of the housing.

3. The carburetor air control mechanism of claim 1 which includes resilient means positioned within the second portion of the housing and urging the closure members toward the orifice plate to close the orifices of the orifice plate.

4. The carburetor air control mechanism of claim 1 which includes an annular connector member positioned within the second portion of the housing and having a plurality of resilient fingers extending radially inwardly therefrom, each of the resilient fingers engaging one of the closure members and urging the closure member toward the orifice plate to close the orifice covered by the closure member.

5. The carburetor air control mechanism of claim 1 in which the air outlet conduits of the housing include a primary air outlet conduit, a secondary air outlet conduit, and an idle air outlet conduit, there being a plurality of orifices of the first group of orifices in communication with the primary air outlet conduit, there being a plurality of orifices of the first group of orifices in communication with the secondary air outlet conduit, there being a plurality of orifices of the first group of orifices in communication with the idle air outlet conduit, the stems of the closure members being of different predetermined lengths so that the bellows member with expansion thereof moves the actuator rod and the engagement element to move the closure members in sequential order to sequentially open orifices of the second group of orifices for flow of air from the air inlet conduit through respective channels of the channel plate and through orifices of the first group of orifices to the primary air outlet conduit, and to sequentially open orifices of the second group of orifices for flow of air from the air inlet conduit through respective channels of the channel plate and through orifices of the first group of orifices to the secondary air outlet conduit, and to sequentially open orifices of the second group of orifices for flow of air between the air inlet conduit through respective channels of the channel plate and through orifices of the first group of orifices to the idle air outlet conduit.

6. The carburetor air control mechanism of claim 5 in which each of the first said orifices of the second group of orifices has a given area, and in which each of the second said orifices of the second group of orifices has a smaller area, and in which each of the third said orifices of the second group of orifices has an area smaller than the area of each of the second said orifices of the second group of orifices.

7. The carburetor air control mechanism of claim 5 in which the stems of the closure members are of different lengths, the stem of a closure member which moves to permit flow of air to the primary air outlet conduit having a length equal to the length of a stem of a closure member which opens to permit flow of air to the secondary air outlet conduit, and having a length equal to the length of a stem of a closure member which opens to permit flow of air to the idle air outlet conduit.

* * * * *

UNITED STATES PATENT AND TRADEMARK OFFICE

CERTIFICATE OF CORRECTION

PATENT NO. : 4,276,237

DATED : June 30, 1981

INVENTOR(S) : Glenn B. Barker and William K. Coburn, III

It is certified that error appears in the above-identified patent and that said Letters Patent are hereby corrected as shown below:

Column 3, line 42, change "band" to ---barrel---;

line 43, change "band" to ---barrel---.

Signed and Sealed this

*Fifteenth* Day of *September 1981*

[SEAL]

*Attest:*

GERALD J. MOSSINGHOFF

*Attesting Officer*

*Commissioner of Patents and Trademarks*